US006875957B2

(12) United States Patent
Taplan et al.

(10) Patent No.: US 6,875,957 B2
(45) Date of Patent: Apr. 5, 2005

(54) GLASS OR GLASS CERAMIC COOKING TOP WITH AN ELECTRICAL HEATING UNIT

(75) Inventors: Martin Taplan, Rheinbollen (DE); Sascha Backes, Weinsheim (DE); Christiane Baum, Louisville, KY (US); Ted Wegert, Louisville, KY (US)

(73) Assignee: Scott Glas, Mainz (DE)

( * ) Notice: Subject to any disclaimer, the term of this patent is extended or adjusted under 35 U.S.C. 154(b) by 0 days.

(21) Appl. No.: 10/695,648

(22) Filed: Oct. 28, 2003

(65) Prior Publication Data

US 2004/0149724 A1 Aug. 5, 2004

(30) Foreign Application Priority Data

Oct. 29, 2002 (DE) ..... 102 50 317

(51) Int. Cl.[7] ..... H05B 3/68

(52) U.S. Cl. ..... 219/405.1; 219/467.1; 219/448.1; 219/505; 219/466.1; 219/543; 219/452.1; 219/458.1

(58) Field of Search ..... 219/465.1, 467.1, 219/505, 466.1, 448.1, 543, 452.12, 460.1, 448.11, 458.1

(56) References Cited

U.S. PATENT DOCUMENTS

| | | | | |
|---|---|---|---|---|
| 3,953,711 | A | 4/1976 | Eck et al. | |
| 5,220,155 | A | 6/1993 | Cunningham | 219/448.11 |
| 5,221,829 | A | 6/1993 | Yahav et al. | |
| 6,037,572 | A | 3/2000 | Coates et al. | 219/451.1 |
| 6,580,058 | B2 | 6/2003 | Gratz et al. | 219/448.11 |
| 6,753,509 | B2 | 6/2004 | Gratz et al. | 219/448.17 |

FOREIGN PATENT DOCUMENTS

| | | |
|---|---|---|
| DE | 197 11 541 A1 | 9/1998 |
| JP | 05 340 549 A | 12/1993 |

*Primary Examiner*—Shawntina Fuqua
(74) *Attorney, Agent, or Firm*—Fulbright & Jaworski L.L.P.

(57) ABSTRACT

A glass or glass ceramic cooking top 1 has on its underside 6 at least one heating unit 7. The heating unit 7 is in flat, heat-conducting contact with the underside 6, and contains an electrical resistance heating element exhibiting PTC behavior, the temperature in zone 3 being limited to a desired value without the use of a temperature limiter.

9 Claims, 5 Drawing Sheets a.)

b.)

GLASS OR GLASS CERAMIC COOKING TOP WITH AN ELECTRICAL HEATING UNIT

FIELD OF THE INVENTION

The invention relates to a glass or glass ceramic cooking top having at least one zone to be heated, in particular a cooking, grilling, or warming zone, and an electrical heating unit provided on the underside of the zone.

BACKGROUND OF THE INVENTION

Such apparatus as described above are known commercially. The flat, smooth, pore-free surface of the glass or glass ceramic cooking top allows for easy cleaning. The cooking, grilling, or warming zones according to the prior art are heated by radiant heating elements having spirally wound resistance wires, or tubular heating elements, heating films, or halogen lamps. A temperature limiter is provided to protect the glass or glass ceramic cooking top from overheating. A cutoff temperature of 560° C. to 600° C. is selected for cooking operations. For a warming zone, a cutoff temperature of approximately 100° C. to 150° C. is selected.

Temperature limiters are expensive, with costs in the same range as the heating unit. To avoid temperature limiters, the specific heating capacity of the heating unit could be designed low enough so that overheating of the glass or glass ceramic cooking top would be prevented under all operating conditions. However, this would have the disadvantage of a very lengthy heat-up time, as well as considerable thermal inertia in supplying heat to a cold cooking utensil.

U.S. Pat. No. 5,220,155 describes a heating unit for a glass ceramic cooking top in which heating elements exhibiting PTC behavior are provided on a heat sink disk. The heat sink disk is made of an electrically insulating material with good thermal conductivity, such as aluminum nitrite. A disk made of such a material is costly.

OBJECTS AND SUMMARY OF THE INVENTION

The object of the present invention is to provide a glass or glass ceramic cooking top of the aforementioned type, having a heating unit which operates in an intrinsically safe manner by virtue of a simple design and which in spite of a short heat-up time does not result in overheating of the glass or glass ceramic cooking top, so that a temperature limiter is unnecessary.

The above-referenced object is achieved by the present invention The PTC (positive temperature coefficient) behavior of the resistance heating element causes the affected zone of the glass or glass ceramic cooking top to first heat up quickly, after which the electrical resistance of the heating element becomes so high that no significant further heating of the affected zone occurs. The glass or glass ceramic cooking top is thus protected from overheating without a temperature limiter being necessary.

The described design is economical and robust. The geometry of such a heating unit may be easily adapted to different shapes of the affected zone.

The heating unit is preferably pressed onto the underside by spring elements or adhesively bonded to the underside. A layer of heat sink paste may be provided to improve the heat transfer from the heating unit to the zone.

The heating unit may be formed from a flat, metallic, heat-conducting support element which is adapted to the shape of the zone and lies flat against the underside of the zone. The heating element(s) are positioned on or in the support element.

It is also possible to apply the heating element to the underside of the zone using thick-film technology.

Further advantageous embodiments arise from the following description and the drawings.

DETAILED DESCRIPTION

Figure 1:
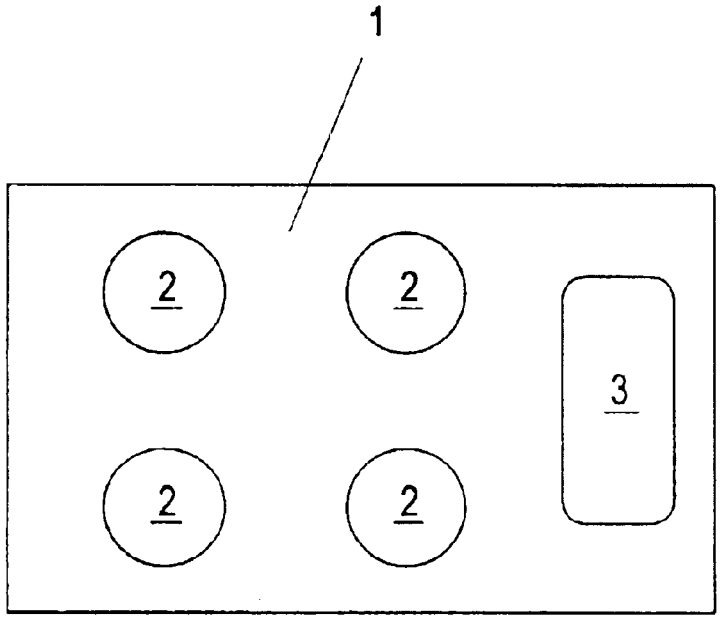
FIG. 1 shows a top view of a glass or glass ceramic cooking top having four cooking zones and one rectangular warming zone.
Figure 2:
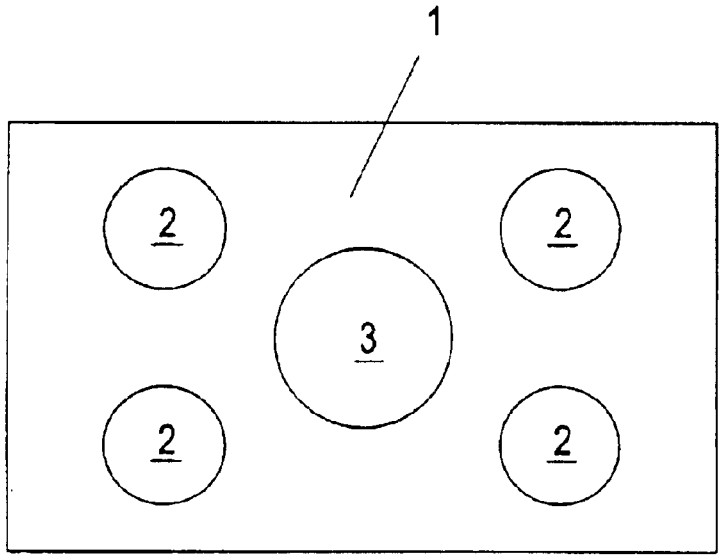
FIG. 2 shows a top view of a glass or glass ceramic cooking top having four cooking zones and one circular warming zone.
Figure 3:
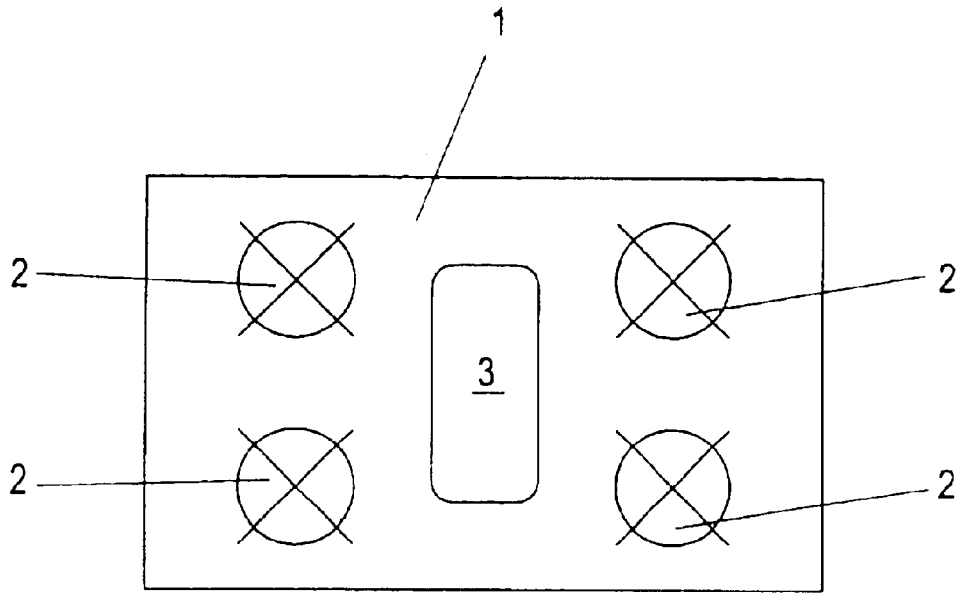
FIG. 3 shows a top view of a glass or glass ceramic cooking top having four gas cooking zones and one electrical warming zone.

A glass or glass ceramic cooking top 1 for a cooking range has four cooking zones 2 and one warming zone 3 (see FIGS. 1, 2, and 3). Warming zone 3 can be provided at various locations on glass or glass ceramic cooking top 1. In FIG. 1, the warming zone is provided in the edge region of glass or glass ceramic cooking top 1, and in FIGS. 2 and 3 it is located between cooking zones 2. Warming zone 3 may have various shapes; in FIGS. 1 and 3 it is rectangular, and in FIG. 2 it is circular.

Cooking zones 2 in FIGS. 1 and 2 are heated by electrical radiation heating elements known per se. However, these cooking zones may also be heated by heating units, which are as described below for warming zone 3.

Cooking zones 2 may also be heated by gas in a manner known per se (see FIG. 3).

Figure 4:
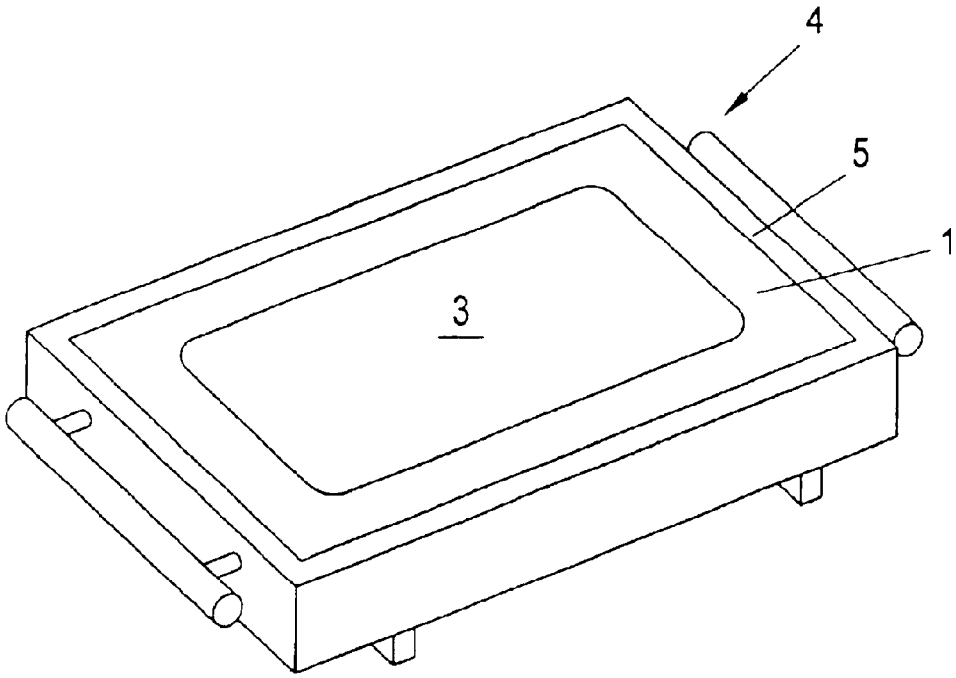
FIG. 4 shows a perspective view of a tabletop unit having a warming zone.

FIG. 4 shows a table-mountable portable unit 4 having a housing 5 which supports a glass or glass ceramic cooking top 1 on which a rectangular warming zone 3 is provided. This zone may also be designed as a grilling zone upon which foods to be grilled are directly placed.

FIGS. 1 through 4 show embodiments by way of example only. The heating unit described below for a warming zone 3 may also be used in cooking zones or grilling zones of various shapes, such as circular, square, or oval, with various unit designs such as built-in cooking tops, tabletop cooking units, free-standing stoves, outdoor cooking units, or camping units.

A heating unit 7 is provided on underside 6 of glass or glass ceramic cooking top 1 in the region of warming zone 3 or in zones used for other purposes. This heating unit has a surface region 8 which extends on underside 6, essentially over the entire area of warming zone 3. This extension may also be accomplished by positioning two or more heating units 7 side by side on underside 6 (see FIG. 10). Surface region 8 is in flat, heat-conducting contact with underside 6 in the region of cooking zone 2 in order to achieve good heat transfer from heating unit 7 to warming zone 3.

Figure 5:
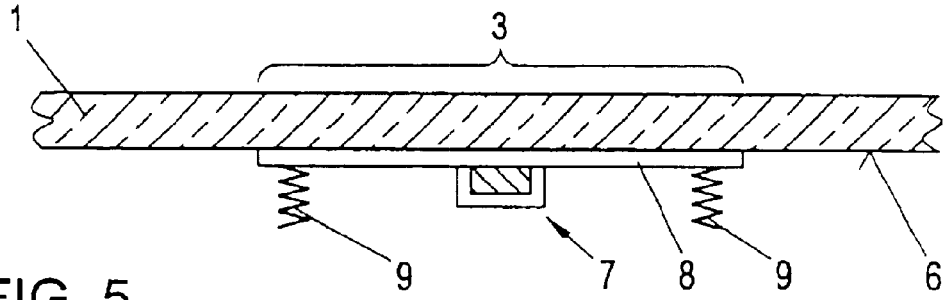
FIGS. 5 through 8 show sections of a glass or glass ceramic cooking top with a heating unit.

In the embodiment according to FIG. 5, surface region 8 is pressed tightly against underside 6 by spring elements, in particular a plurality of pressure springs 9 situated in the edge region. Pressure springs 9 rest on a base part or a fastening crossmember (not shown) in the housing which supports glass or glass ceramic cooking top 1.

Figure 6:
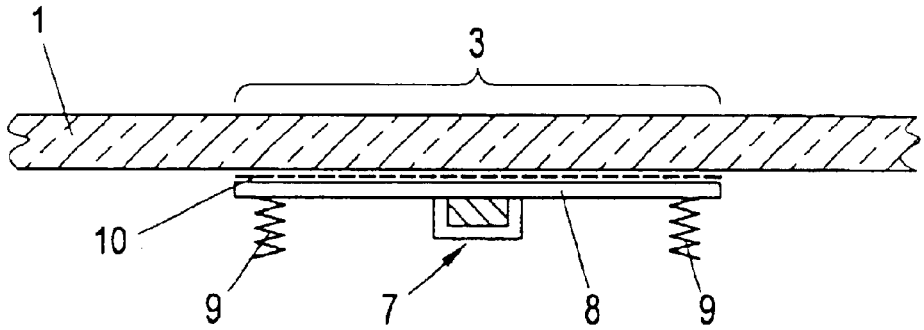

In the embodiment according to FIG. 6, a layer 10 of heat sink paste is also provided between the bottom 6 and the heater unit 7 to improve the heat transfer compared to FIG. 5.

Figure 7:
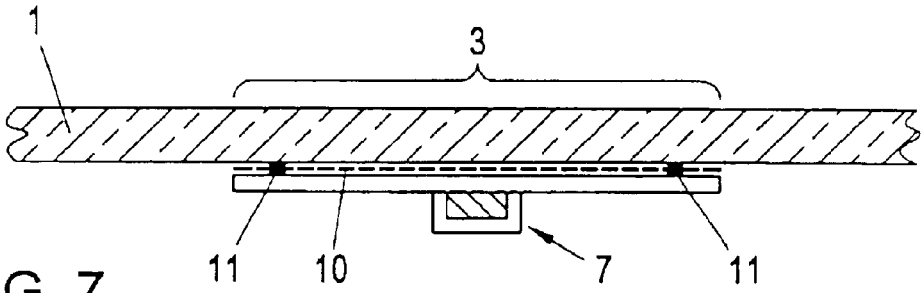

In the embodiment according to FIG. 7 spring elements are omitted, and surface region 8 is instead adhesively bonded at certain points 11 to underside 6. A layer 10 of heat sink paste is provided here as well. Layer 10 of heat sink paste is particularly advantageous when underside 6 has a textured, for example napped, surface.

Figure 8:
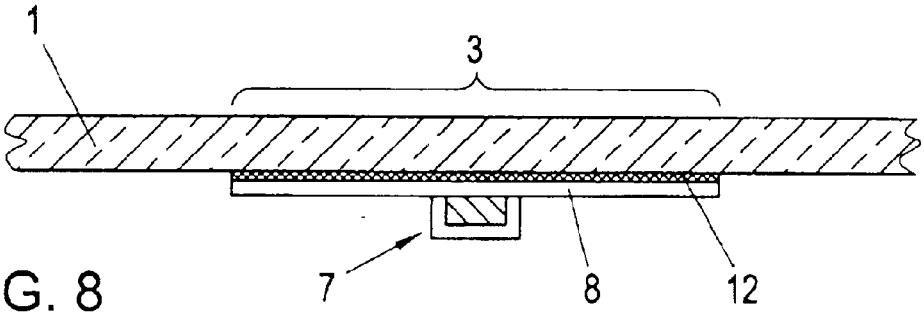
Figure 9:
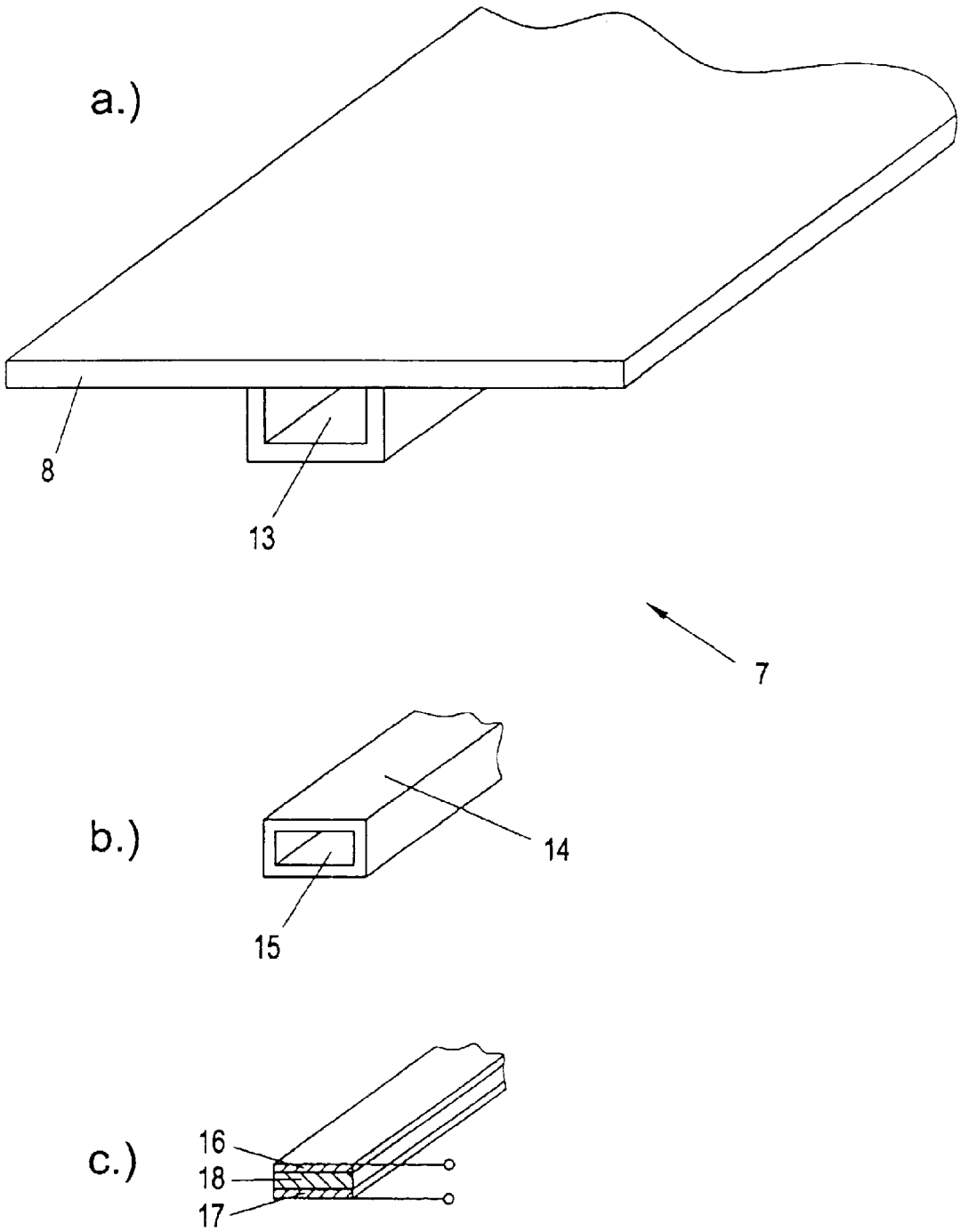
FIG. 9 shows a perspective view of the heating unit, showing a) a support element, b) an insulation element, and c) the heating unit.

In the exemplary embodiment according to FIG. 8, the entire area of surface region 8 of heating unit 7 is glued to underside 6 with an adhesive layer 12, compared to adhesive bond 11 which is achieved by glued points or glued seams as shown in FIG. 7. FIG. 9 shows heating unit 7. A shaft 13 is provided on surface region 8 (see FIG. 9*a*). Surface region 8 and shaft 13 are produced from a continuous-cast aluminum profile, for example. Shaft 13 runs approximately along the lengthwise centerline of surface region 8. An electrically insulating insulator 14 (see FIG. 9*b*), which may be designed to have two or more layers, is to be inserted into shaft 13. Insulator 14 forms a receiving space 15 into which resistance heating element 18, which is electrically contacted using electrodes flat on both sides, is to be inserted. Heating element 18 is rod-shaped.

Heating element 18 has a positive temperature coefficient of electrical resistance. Its electrical resistance therefore increases with increasing temperature. Such PTC heating elements are known, and are usually made of doped polycrystalline ceramic using barium titanate, for example, as base material. Electrodes 16, 17 are used to conduct current as well as to transfer heat from heating element 18 to surface region 8 via insulator 14 and shaft 13.

Heating element 18 has a characteristic curve which represents the electrical resistance of the heating element as a function of temperature (PTC characteristic curve or RT characteristic curve). A heating element 18 is used in which the operating range lies predominantly in the low-impedance portion of the characteristic curve. The selection is made according to the desired function of the heating unit for the warming zone or for a cooking zone. At an initial low temperature, heating occurs with high heat output due to the correspondingly low resistance. As the temperature increases, the heat output diminishes in accordance with the characteristic curve, as a result of which no further heating of zone 3 occurs above a temperature specified by the choice of the characteristic curve. Heating unit 7 has self-regulating characteristics with regard to the temperature of zone 3. When a cold cooking utensil or cooking material is placed on zone 3, which has been heated to its final temperature, the temperature of heating element 18 is reduced on account of the heat conduction, so that the heat output of the heating element again increases. Altogether, a sensitive regulation and limitation of the temperature in zone 3 is thus achieved, although glass or glass ceramic cooking top 1 itself has poor heat conduction properties.

Figure 10:
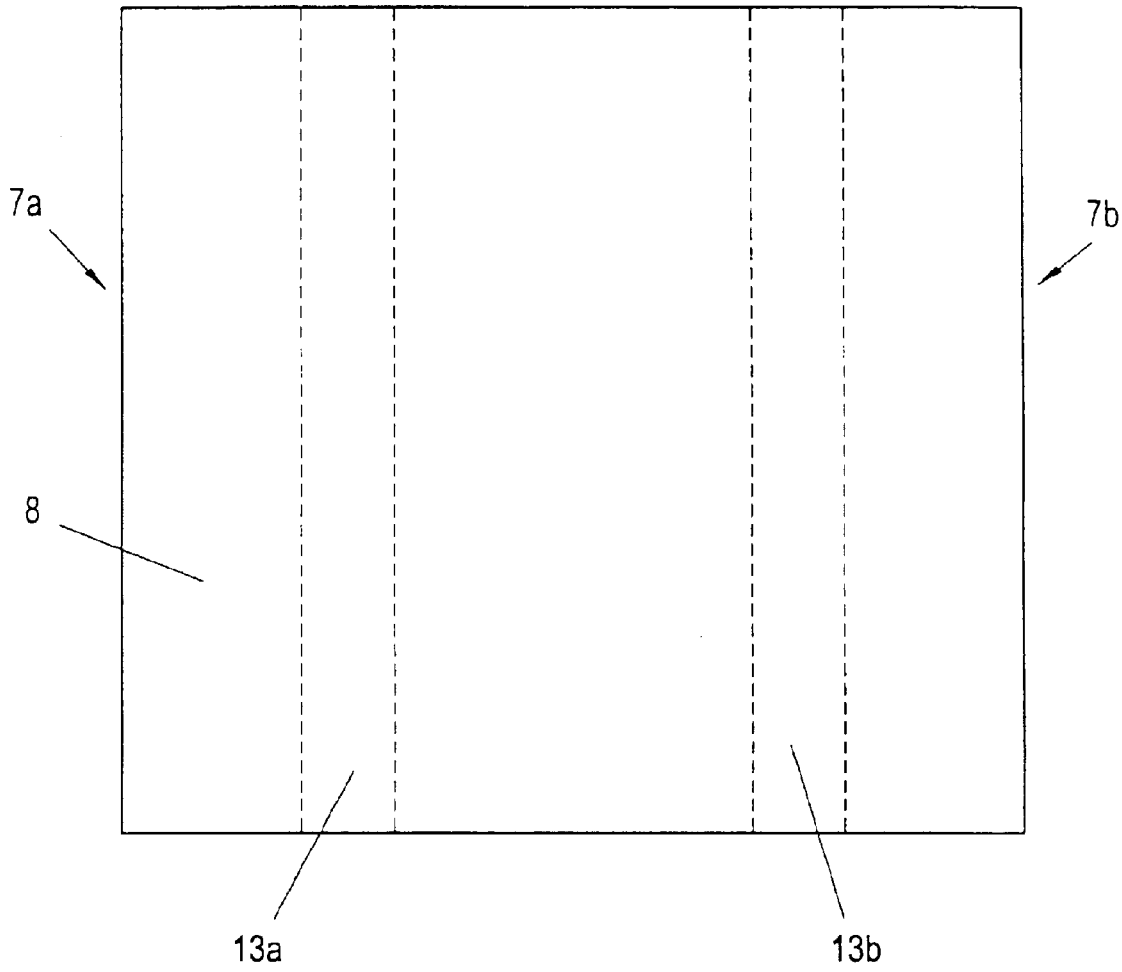
FIG. 10 shows two side-by-side heating units according to FIGS. 1 through 4 for heating a warming zone.
Figure 10:
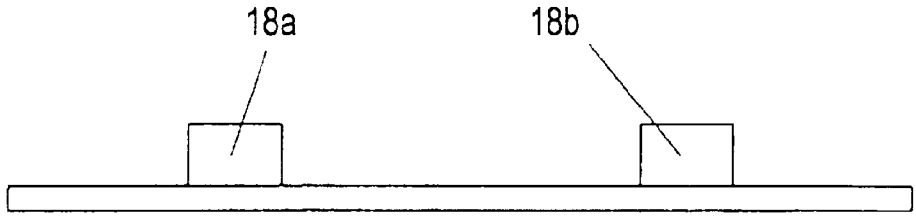

The heat-up speed of zone 3 may be increased by the invention, using two or more PTC heating elements. FIG. 10 shows, similarly to FIG. 9, two heating units 7*a* and 7*b* situated side by side which cover zone 3 with their combined surface region 8. A heating element 18*a*, 18*b* is situated in shaft 13*a*, 13*b*, respectively. The number of PTC heating elements 7*a, b* can be further increased to achieve a higher output.

In another embodiment it is possible to apply heating unit 7 to underside 6 of zone 3 using thick-film technology. Heating unit 7 has an electrical resistance layer, exhibiting the described PTC behavior, situated between two electrically conductive electrode layers. The one electrode layer may be applied directly to underside 6.

This is particularly the case when the glass or glass ceramic cooking top produces sufficient electrical insulation in the temperature range of interest, for example in a warming zone. However, if zone 3 is provided as a cooking zone with higher temperatures than a warming zone, an electrically insulating intermediate layer can be provided between the electrode layer and underside 6 in order to ensure electrical insulation, even at temperatures at which the electrical conductivity of the glass or glass ceramic cooking top increases.

What is claimed is:

1. A cooking top comprising at least one of a glass and a glass ceramic and having at least one heating zone and an underside; at least one electrical heating unit provided on the underside of said heating zone, wherein said heating unit is in flat, heat-conducting contact with the underside of said heating zone; wherein said heating unit comprises at least one electrical resistance heating element exhibiting PTC behavior, wherein the PTC characteristic curve is selected so that the temperature of said heating zone is limited to a desired value, and said heating unit having a metallic heat-conducting support element which forms a surface region and upon or in which the heating element is situated, said metallic heat-conducting support element being in flat contact with the underside of the heating zone, wherein on the metallic, heat-conducting support element of the heating unit at least one shaft is provided into which the heating element is inserted, and that the heating element is electrically insulated with respect to the support element by an insulator.

2. The cooking top according to claim 1, wherein the heating unit is pressed flat against the underside of the zone by spring elements.

3. The cooking top according to claim 1, wherein the heating unit is adhesively bonded to the underside of the zone at specific points, or in the form of a seam, or flush to the underside.

4. The cooking top according to claim 1, wherein the desired temperature value corresponds to a warming temperature, a cooking temperature, or a grilling temperature.

5. The cooking top according to claim 1, wherein a layer of heat sink paste is applied between the underside and the heating unit.

6. The cooking top according to claim 1, wherein the support element is electrically insulated with respect to the underside by an intermediate layer.

7. The cooking top according to claim 1, wherein the heating element is formed from a rod-shaped ceramic element which exhibits PTC properties and on which electrodes flat on both sides are situated.

8. The cooking top according to claim 1, wherein the surface region of said heating element, is smaller than that of the said support element.

9. The cooking top according to claim 1, wherein at least two heating units are positioned side by side on the underside of the zone and extend over the underside of said heating zone.

* * * * *

UNITED STATES PATENT AND TRADEMARK OFFICE

CERTIFICATE OF CORRECTION

PATENT NO. : 6,875,957 B2
DATED : April 5, 2005
INVENTOR(S) : Martin Taplan

It is certified that error appears in the above-identified patent and that said Letters Patent is hereby corrected as shown below:

Title page,
Item [73], Assignee, change "Scott Glas, Mainz (DE)" to -- Schott Glas, Mainz (De) --.

Signed and Sealed this

Twenty-eighth Day of June, 2005

JON W. DUDAS
*Director of the United States Patent and Trademark Office*